US012180643B2

(12) United States Patent
Wu et al.

(10) Patent No.: US 12,180,643 B2
(45) Date of Patent: Dec. 31, 2024

(54) CLOTHES DRYER

(71) Applicant: Jiangsu Yoau Electric Co., Ltd., Changzhou (CN)

(72) Inventors: Qingping Wu, Changzhou (CN); Binghua Huang, Changzhou (CN); Zhu Liu, Changzhou (CN); Qintao Zhou, Changzhou (CN)

(73) Assignee: Jiangsu Yoau Electric Co., Ltd., Changzhou (CN)

( * ) Notice: Subject to any disclaimer, the term of this patent is extended or adjusted under 35 U.S.C. 154(b) by 769 days.

(21) Appl. No.: 17/383,466

(22) Filed: Jul. 23, 2021

(65) Prior Publication Data

US 2022/0316129 A1 Oct. 6, 2022

(30) Foreign Application Priority Data

Apr. 1, 2021 (CN) ..... 202110357170.5

(51) Int. Cl.
*D06F 58/20* (2006.01)
*D06F 34/05* (2020.01)
(Continued)

(52) U.S. Cl.
CPC ..... *D06F 58/206* (2013.01); *D06F 34/05* (2020.02); *D06F 58/02* (2013.01); *D06F 58/22* (2013.01); *D06F 58/38* (2020.02); *D06F 58/45* (2020.02); *D06F 2105/26* (2020.02); *D06F 2105/54* (2020.02)

(58) Field of Classification Search
CPC ..... D06F 58/206; D06F 34/05; D06F 58/02; D06F 58/22; D06F 58/38; D06F 58/45; D06F 2105/26; D06F 2105/54; D06F 58/24; D06F 58/20
See application file for complete search history.

(56) References Cited

U.S. PATENT DOCUMENTS

2009/0151191 A1* 6/2009 Grunert ..... D06F 58/22 34/82
2020/0267251 A1* 8/2020 Cabaleiro Martins ..... H04L 12/282

FOREIGN PATENT DOCUMENTS

EP 2497856 A1 9/2012
JP 2009195362 A * 9/2009
(Continued)

OTHER PUBLICATIONS

Translation, KR-20160059982-A (Year: 2016).*
Translation, JP-2009195362-A (Year: 2009).*

*Primary Examiner* — Jessica Yuen
(74) *Attorney, Agent, or Firm* — Bayramoglu Law Offices LLC

(57) ABSTRACT

A clothes dryer includes a housing, a tumbler and a heat exchange component. The housing has an air cavity therein. The air cavity and the tumbler form a closed-loop air duct. A blower impeller for driving air to flow is provided in the housing. The heat exchange component comprises a compressor, a condenser and an evaporator. The compressor is used to compress a working medium into a high temperature and high pressure state, and the condenser communicates with the evaporator through a throttle capillary. The heat exchange component further includes a reversing valve. The reversing valve can switch between two modes through a remote control program. The clothes dryer can perform self-cleaning.

8 Claims, 3 Drawing Sheets

(51) Int. Cl.

| | |
|---|---|
| ***D06F 58/02*** | (2006.01) |
| ***D06F 58/22*** | (2006.01) |
| ***D06F 58/38*** | (2020.01) |
| ***D06F 58/45*** | (2020.01) |
| ***D06F 105/26*** | (2020.01) |
| ***D06F 105/54*** | (2020.01) |

(56) References Cited

FOREIGN PATENT DOCUMENTS

| | | | | |
|---|---|---|---|---|
| JP | 4531414 | B2 | | 8/2010 |
| KR | 20160059982 | A | * | 5/2016 |

* cited by examiner

CLOTHES DRYER

CROSS REFERENCES TO THE RELATED APPLICATIONS

This application is based upon and claims priority to Chinese Patent Application No. 202110357170.5, filed on Apr. 1, 2021, the entire contents of which are incorporated herein by reference.

TECHNICAL FIELD

The present invention relates to a technical field of clothes drying, and in particular, to a clothes dryer.

BACKGROUND

Clothes dryers, such as a heat pump clothes dryer, work in the way that a motor drives a blower impeller to rotate so that air circulates in a directional air duct of a machine body, and when wet clothes are put into a tumbler, dry hot air is generated by using a compressor and a heat exchanger and then enters the tumbler to heat the clothes so as to take away water vapor. The existing heat pump clothes dryer includes a mesh filter installed at a front end of an evaporator in a heat exchanger. The mesh filter is configured to prevent flocks and debris from being first attached to the evaporator after the debris has left the tumbler. Also, since the evaporator is configured to generate condensate water and has a wet surface during work hours, impurities are likely to adhere to the surface of the evaporator. However, the existing clothes dryers hardly perform self-cleaning.

Thus, it is necessary to provide a clothes dryer to solve the above problem.

SUMMARY

The technical problem to be solved by the present invention is to provide a clothes dryer capable of performing self-cleaning.

The technical solution adopted by the present invention to solve its technical problem is to provide a clothes dryer, including a housing, a tumbler and a heat exchange component. The housing has an air cavity therein. The air cavity and the tumbler form a closed-loop air duct. A blower impeller for driving air in the closed-loop air duct to flow is provided in the housing. The heat exchange component includes a compressor, and a condenser and an evaporator. The condenser and the evaporator are arranged inside the air cavity. The compressor is used to compress a working medium into a high temperature and high pressure state. The condenser communicates with the evaporator through a throttle capillary. The heat exchange component further includes a reversing valve. The reversing valve can switch between two modes through a remote control program. In a first mode, the working medium can flow from the compressor to the condenser via the reversing valve, the working medium in the condenser flows into the evaporator, and the working medium in the evaporator flows back to the compressor via the reversing valve. In a second mode, the working medium can flow from the compressor to the evaporator via the reversing valve, the working medium in the evaporator flows into the condenser, and the working medium in the condenser flows back to the compressor via the reversing valve.

Further, the blower impeller is installed in the air cavity, the blower impeller is near to one end of the air cavity, and a motor for driving the blower impeller to rotate is installed in the housing corresponding to the blower impeller.

Further, a blower cover is installed at the back of the housing, the blower cover covers the one end of the air cavity near to the blower impeller and one end of the tumbler, and the other end of the tumbler communicates with the other end of the air cavity.

Further, the housing is provided with a mesh filter located in the air cavity therein.

Further, the compressor is fixedly installed on the bottom of the housing, and the compressor has an air discharge pipe for discharging the working medium and an air return pipe for backflow of the working medium thereon.

Further, the evaporator is located at a front end of the air duct of the air cavity relative to the condenser.

Further, a condenser is provided with a condenser connection pipe, and the condenser connection pipe and the throttle capillary are connected to both ends of an inner duct of the condenser, respectively.

Further, the evaporator has an evaporator connection pipe thereon, the evaporator connection pipe is connected to one end of an inner duct of the evaporator, and the other end of the inner duct of the evaporator is connected to the other end of the throttle capillary.

Further, the reversing valve is a four-way reversing valve.

Further, one end of each of the air discharge pipe, the air return pipe, the condenser connection pipe and the evaporator connection pipe is connected to the reversing valve.

The present invention has the following advantages. In the clothes dryer of the present invention, the heat exchange component further includes the reversing valve, and the reversing valve can switch between two modes. In the first mode, the working medium flows from the compressor to the condenser via the reversing valve, the working medium in the condenser flows into the evaporator, and the working medium in the evaporator flows back to the compressor via the reversing valve. In the second mode, the working medium flows from the compressor to the evaporator via the reversing valve, the working medium in the evaporator flows into the condenser, and the working medium in the condenser flows back to the compressor via the reversing valve. Consequently, when it needs to be cleaned up, first the reversing valve in the heat exchange component switches to the first mode and the blower impeller is controlled to stop rotating, so that the high temperature and high pressure working medium that enters the condenser is converted to the low temperature and low pressure working medium by the throttle capillary and then enters the evaporator, thereby decreasing a temperature of the evaporator and condensing water vapor in the air to frost on a surface of the evaporator. After running for a period of time, a control program controls the reversing valve to switch to the second mode. At the time, the high temperature and high pressure working medium flows into the evaporator and then the evaporator is in a high temperature state so that the frost on the surface of the evaporator thaws into liquid water, and the liquid water flows downward to drive the flocks attached to the surface of the evaporator to fall off. After running for a period of time, the blower impeller is started to circulate the air between the tumbler and the air cavity after the air is heated up via the evaporator, and then the hot air blows the flocks remaining on the surface of the evaporator to clean the surface of the evaporator more thoroughly, thereby implementing self-cleaning.

BRIEF DESCRIPTION OF THE DRAWINGS

The present invention is further illustrated in conjunction with the following drawings and embodiments.

In the drawings.

1. housing; 11. air cavity; 12. blower impeller; 13. mesh filter; 14. blower cover; 2. tumbler;

3. heat exchange component; 31. compressor; 311. air discharge pipe; 312. air return pipe; 32. condenser; 321. condenser connection pipe; 322. throttle capillary; 33. evaporator; 331. evaporator connection pipe; 34. reversing valve.

DETAILED DESCRIPTION OF THE EMBODIMENTS

The present invention is described in detail in conjunction with the drawings. The drawings are simplified schematic diagrams, merely schematically illustrate a basic structure of the present invention, and thus only show the components related to the present invention.

Figure 1:
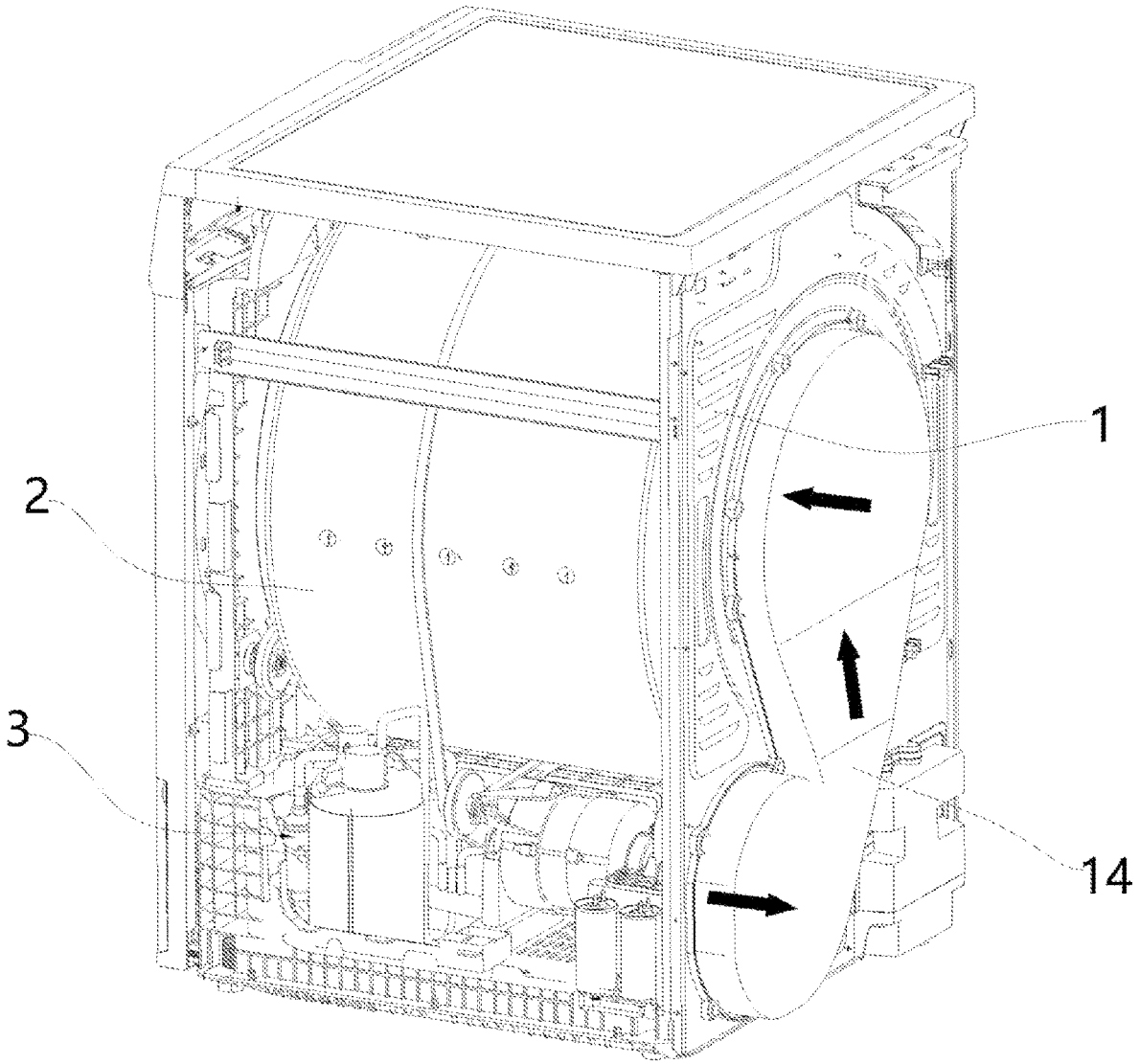
FIG. 1 is an overall schematic diagram of a clothes dryer of the present invention, and illustrates a flow direction of air in a blower cover.

As shown in FIG. 1, the present invention provides a clothes dryer, including the housing 1, and the tumbler 2 and the heat exchange component 3 installed in the housing 1. Air in the clothes dryer circulates between the tumbler 2 and the heat exchange component 3 to dry clothes in the tumbler 2.

The tumbler 2 is rotatably installed in the housing 1.

Figure 2:
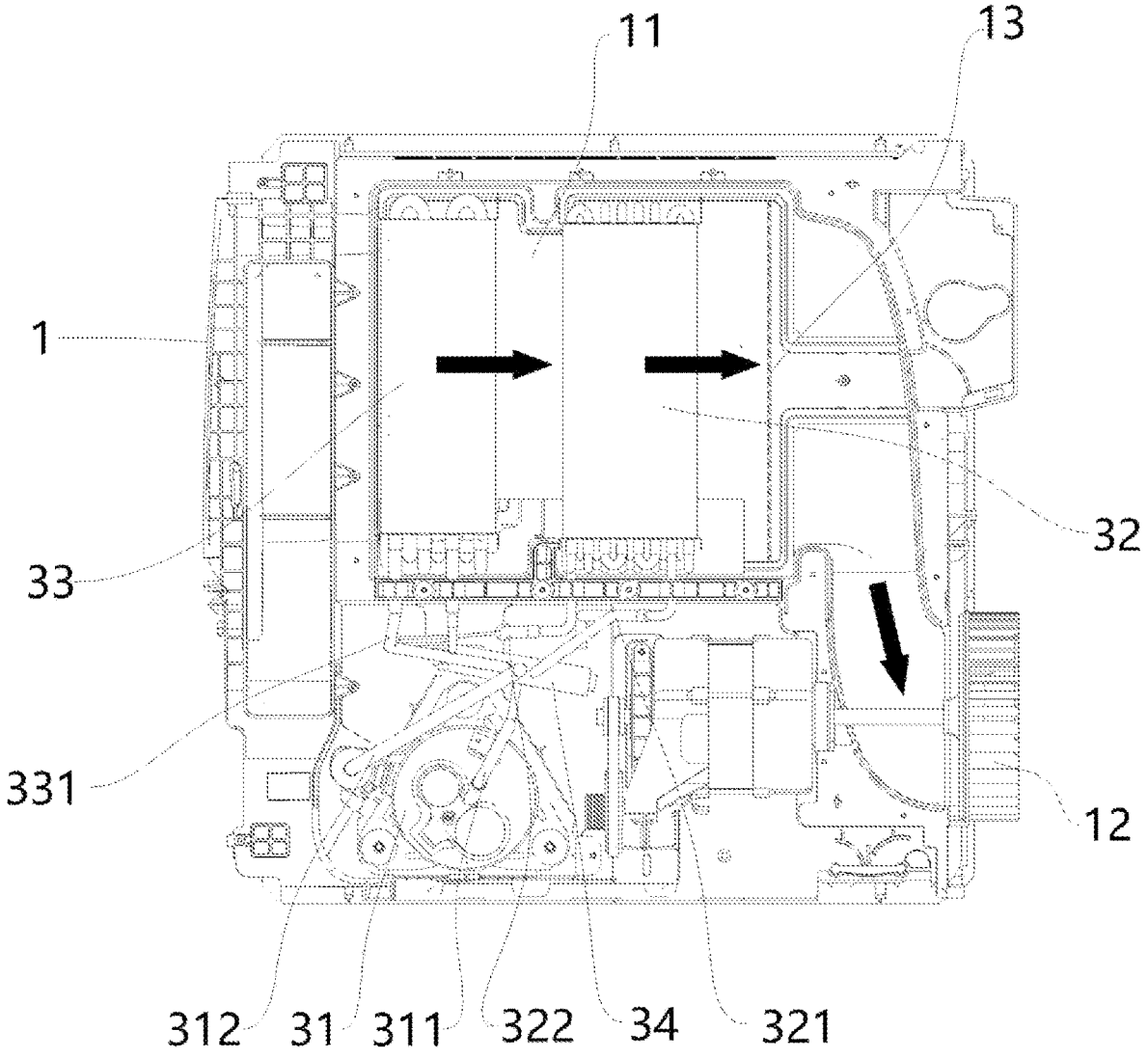
FIG. 2 is a schematic diagram of the assembly between a heat exchange component and a housing in the clothes dryer illustrated in FIG. 1, and illustrates a flow direction of the air in an air cavity.

As shown in FIG. 2, a bottom of the housing 1 has the air cavity 11, the air cavity 11 is located below the tumbler 2, and the air cavity 11 and the tumbler 2 form a closed-loop air duct. The blower impeller 12 located in the air cavity 11 is installed in the housing 1, and the blower impeller 12 is used to drive the air in the closed-loop air duct to flow. Specifically, the blower impeller 12 is near to one end of the air cavity 11, and a motor is installed in the housing 1 corresponding to the blower impeller 12 and is configured for driving the blower impeller 12 to rotate so as to drive the air to flow. The one end of the air cavity 11 near to the blower impeller 12 communicates with one end of the tumbler 2. As shown in FIG. 1, for example, the blower cover 14 is installed at a back of the housing 1, the blower cover 14 covers the one end of the air cavity 11 near to the blower impeller 12 and the one end of the tumbler 2, and the other end of the tumbler 2 communicates with the other end of the air cavity 11 such that the air cavity 11 and the tumbler 2 form the closed-loop air duct, and the air circulates between the tumbler 2 and the heat exchange component 3 under the driving of the blower impeller 12.

In a specific embodiment, the mesh filter 13 located in the air cavity 11 is further installed in the housing 1 and the mesh filter 13 is located behind the evaporator 33. The mesh filter 13 is used to block impurities from entering the tumbler 2 and contaminating the tumbler 2, and does not function to filter the impurities for the evaporator 33 and the condenser 32 in the heat exchange component 3. The mesh number of the mesh filter 13 is not specifically required. In the present embodiment, the mesh filter 13 is located between the condenser 32 and the blower impeller 12.

Figure 3:
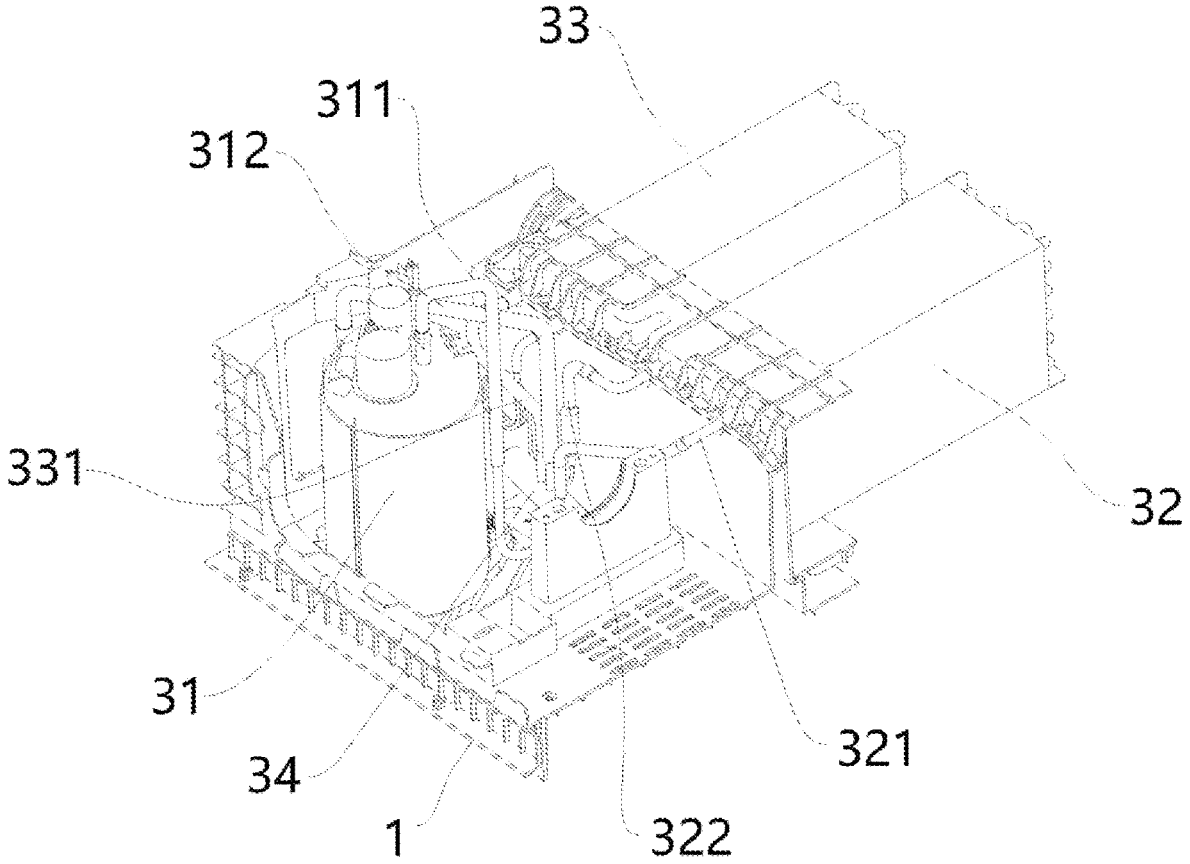
FIG. 3 is a schematic perspective view of FIG. 2.

As shown in FIGS. 2 and 3, the heat exchange component 3 includes the compressor 31, the condenser 32, the evaporator 33 and the reversing valve 34.

The compressor 31 is fixedly installed on a bottom of the housing 1. The compressor 31 has the air discharge pipe 311 and the air return pipe 312 thereon. The compressor 31 is used to compress the low temperature and low pressure working medium (such as a refrigerant) to a high temperature and high pressure state and then discharge it via the air discharge pipe 311. The air return pipe 312 is configured for the working medium to flow into the compressor 31.

The condenser 32 and the evaporator 33 are accommodated in the air cavity 11, and the condenser 32 and the evaporator 33 are distributed inside the air cavity 11 along a length direction of the air cavity 11. In particular, the evaporator 33 is located at a front end of the air duct of the air cavity 11 relative to the condenser 32.

The condenser 32 has the condenser connection pipe 321 and the throttle capillary 322 thereon. The condenser connection pipe 321 and the throttle capillary 322 are respectively connected to both ends of an inner duct of the condenser 32. The throttle capillary 322 communicates with the condenser 32 and the evaporator 33.

The evaporator 33 has the evaporator connection pipe 331 thereon. The evaporator connection pipe 331 is connected to one end of an inner duct of the evaporator 33, and the other end of the inner duct of the evaporator 33 is connected to the other end of the throttle capillary 322. Accordingly, the working medium can flow between the condenser 32 and the evaporator 33 through the throttle capillary 322.

In the present embodiment, the reversing valve 34 is a four-way reversing valve, where one end of each of the air discharge pipe 311, the air return pipe 312, the condenser connection pipe 321 and the evaporator connection pipe 331 is connected to the reversing valve 34, thereby controlling the reversing valve to switch between two modes. Specifically, in a first mode, the working medium flows from the air discharge pipe 311 into the condenser connection pipe 321 via the reversing valve 34, the working medium in the condenser 32 flows into the evaporator 33, and the working medium flows from the evaporator connection pipe 331 into the air return pipe 312 via the reversing valve 34; in a second mode, the working medium can flow from the air discharge pipe 311 into the evaporator connection pipe 331 via the reversing valve 34, the working medium in the evaporator 33 flows into the condenser 32, and the working medium flows from the condenser connection pipe 321 into the air return pipe 312 via the reversing valve 34.

When the clothes dryer of the present invention runs normally, the reversing valve 34 in the heat exchange component 3 is in the first mode. At the time, the compressor 31 compresses the working medium from a low temperature and low pressure state to a high temperature and high pressure state, the high temperature and high pressure working medium passes through the air discharge pipe 311 and flows into the condenser 32 via the condenser connection pipe 321 so as to make the condenser 32 in a high temperature state. The working medium is throttled by the throttle capillary 322 after flowing through the condenser 32 and becomes the low temperature and low pressure state, and then the low temperature and low pressure working medium enters the evaporator 33 so as to make the evaporator 33 in a low temperature state. The low temperature and low pressure working medium flows from the evaporator connection pipe 331 into the air return pipe 312 via the reversing valve 34, the working medium returns to the compressor 31 through the air return pipe 312, and the heat exchange component 3 completes the cycle. When the heat exchange component 3 is working, the blower impeller 12 is working at the same time to drive the air to directionally circulate between the tumbler 2 and the heat exchange component 3. Specifically, the air enters the tumbler 2 through the blower cover 14 after the air is heated up by the high temperature condenser 32, and then the hot air is in contact with the wet clothes in the tumbler 2 and then takes away water vapor. Subsequently, the moist air enters the air cavity 11 again and first contacts the low temperature evaporator 33 such that the water vapor in the moist air contacts a surface of the evaporator 33 to be liquefied into liquid water, and then the liquid water drips off from the evaporator 33 and is collected. The dry air without moisture is heated up through the condenser 32 and then enters the tumbler 2 again for drying. Such a cycle is repeated to complete the drying of the clothes.

When the clothes dryer is not in use, it can be switched to a cleaning mode. First, the reversing valve 34 in the heat exchange component 3 is in the first mode, the blower impeller 12 stops rotating. The hot air does not circulate through the evaporator 33, the surface temperature of the evaporator 33 drops sharply such that the water vapor in the air condenses and frosts on the surface of the evaporator 33. After running for a period of time, the control program of the clothes dryer controls the reversing valve 34 to the second mode. At the time, since the high temperature and high pressure working medium flows into the evaporator 33, the evaporator 33 is in the high temperature state to thaw the previous frost on the surface of the evaporator 33 into liquid water. The liquid water flows downward to drive the flocks attached to the surface of the evaporator 33 to fall off. After running for a period of time, the blower impeller 12 is started, so that the air circulates between the tumbler 2 and the air cavity 11 after the air is heated up through the evaporator 33. The hot air blows the flocks remaining on the surface of the evaporator 33 to further clean up the surface of the evaporator 33. Since the reversing valve 34 was in the first mode previously, most of water vapor inside the clothes dryer has been liquefied and collected, the humidity of the clothes dryer is relatively low. At the time, it is not easy to generate a large amount of condensed water on the surface of the condenser 32. Furthermore, the condenser 32 is located behind the high temperature evaporator 33, so that the circulated hot air will continuously dry the evaporator 33 and the condenser 32, and the flocks remaining on the evaporator 33 is filtered by the mesh filter 13, which is not easily attached to the condenser 32 after the flocks are blown off. Thus, the surface of the condenser 32 is also cleaned up.

Therefore, the clothes dryer of the present invention at least has the following advantageous effects.

In the clothes dryer of the present invention, the heat exchange component 3 further includes the reversing valve 34, and the reversing valve 34 can switch between two modes. In a first mode, the working medium flows from the compressor 31 to the condenser 32 via the reversing valve 34, the working medium in the condenser 32 flows into the evaporator 33, and the working medium in the evaporator 33 flows back to the compressor 31 via the reversing valve 34. In a second mode, the working medium flows from the compressor 31 to the evaporator 33 via the reversing valve 34, the working medium in the evaporator 33 flows into the condenser 32, and the working medium in the condenser 32 flows back to the compressor 31 via the reversing valve 34. When it needs to be cleaned up, first the reversing valve 34 in the heat exchange component 3 switches to the first mode and the blower impeller 12 is controlled to stop rotating, so that the high temperature and high pressure working medium that enters the condenser 32 is converted to the low temperature and low pressure working medium by the throttle capillary 322 and then enters the evaporator 33 to decrease the temperature of the evaporator 33 such that water vapor in the air condenses and frosts on a surface of the evaporator 33. After running for a period of time, a control program controls the reversing valve 34 to switch to the second mode. At the time, the high temperature and high pressure working medium flows into the evaporator 33 via the reversing valve 34 and the evaporator 33 is in a high temperature state so as to thaw the previous frost on the surface of the evaporator 33 into liquid water. The liquid water flows downward to drive the flocks attached to the surface of the evaporator 33 to fall off. After running for a period of time, the blower impeller 12 is started in order to circulate the air between the tumbler 2 and the air cavity 11 after the air is heated up through the evaporator 33. The hot air blows the flocks remaining on the surface of the evaporator 33 to clean the surface of the evaporator 33 more thoroughly, thereby implementing self-cleaning. At the same time, the evaporator 33 does not need to be protected by the blocking effect of the mesh filter, and the working performance of the clothes dryer is not affected.

Taking the above-mentioned ideal embodiment according to the present invention as inspiration, through the above description content, the person in the art can make various changes and modifications without departing from the scope of the present invention. The technical scope of the present invention is not limited to the content of the description, and the technical scope thereof must be determined according to the scope of the claims.

What is claimed is:

1. A clothes dryer, comprising a housing, a tumbler and a heat exchange component, wherein the housing has an air cavity therein, the air cavity located below the tumbler, the air cavity and the tumbler form a closed-loop air duct, a blower impeller for driving air in the closed-loop air duct to flow is provided in the housing, the blower impeller is adjacent to a first end of the air cavity, the heat exchange component comprises a compressor, and a condenser and an evaporator, wherein the condenser and the evaporator are placed inside the air cavity, the compressor is used to compress a working medium into a high temperature and high pressure state, the condenser communicates with the evaporator through a throttle capillary, the heat exchange component further comprises a reversing valve, wherein the reversing valve is configured to switch between a first mode and a second mode, in the first mode, the working medium flows from the compressor to the condenser via the reversing valve, the working medium in the condenser flows into the evaporator, and the working medium in the evaporator flows back to the compressor via the reversing valve, and in the second mode, the working medium flows from the compressor to the evaporator via the reversing valve, the working medium in the evaporator flows into the condenser, and the working medium in the condenser flows back to the compressor via the reversing valve, a blower cover installed at a back of the housing, the blower cover covers the first end of the air cavity near to the blower impeller and a first end of the tumbler, and a second end of the tumbler communicates with a second end of the air cavity, and a mesh filter located in the air cavity and disposed in the air cavity between the condenser and the blower impeller, the mesh filter disposed directly adjacent to the condenser and the blower impeller.

2. The clothes dryer of claim 1, wherein a motor for driving the blower impeller to rotate is installed in the housing corresponding to the blower impeller.

3. The clothes dryer of claim 1, wherein the compressor is fixedly installed on a bottom of the housing, and the compressor comprises an air discharge pipe for discharging the working medium and an air return pipe for backflow of the working medium.

4. The clothes dryer of claim 3, wherein the condenser is further provided with a condenser connection pipe, and the condenser connection pipe and a first end of the throttle capillary are connected to both ends of an inner duct of the condenser, respectively.

5. The clothes dryer of claim 4, wherein the evaporator has an evaporator connection pipe, the evaporator connection pipe is connected to a first end of an inner duct of the evaporator, and a second end of the inner duct of the evaporator is connected to a second end of the throttle capillary.

6. The clothes dryer of claim 5, wherein the reversing valve is a four-way reversing valve.

7. The clothes dryer of claim 6, wherein one end of each of the air discharge pipe, the air return pipe, the condenser connection pipe and the evaporator connection pipe is connected to the four-way reversing valve.

8. The clothes dryer of claim 1, wherein the evaporator is located at a front end of the closed-loop air duct of the air cavity relative to the condenser.

* * * * *